US007756704B2

(12) United States Patent
Yonekubo et al.

(10) Patent No.: US 7,756,704 B2
(45) Date of Patent: Jul. 13, 2010

(54) VOICE/MUSIC DETERMINING APPARATUS AND METHOD

(75) Inventors: Hiroshi Yonekubo, Suginami-ku (JP); Hirokazu Takeuchi, Machida (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/430,763

(22) Filed: Apr. 27, 2009

(65) Prior Publication Data

US 2010/0004928 A1 Jan. 7, 2010

(30) Foreign Application Priority Data

Jul. 3, 2008 (JP) ..... 2008-174698

(51) Int. Cl.
*G10L 21/02* (2006.01)

(52) U.S. Cl. ..... 704/226; 704/233

(58) Field of Classification Search ..... 704/226, 704/233

See application file for complete search history.

(56) References Cited

U.S. PATENT DOCUMENTS

| | | | | |
|---|---|---|---|---|
| 6,570,991 | B1 * | 5/2003 | Scheirer et al. | 381/110 |
| 7,130,795 | B2 * | 10/2006 | Gao | 704/216 |
| 7,191,128 | B2 * | 3/2007 | Sall et al. | 704/233 |
| 2006/0015333 | A1 * | 1/2006 | Gao | 704/233 |
| 2006/0111900 | A1 | 5/2006 | Kim | |
| 2008/0033583 | A1 * | 2/2008 | Zopf | 700/94 |

FOREIGN PATENT DOCUMENTS

| | | |
|---|---|---|
| JP | 06-4088 | 6/1992 |
| JP | 10-187182 | 12/1996 |
| JP | 2000-66691 | 3/2000 |
| JP | 2004-125944 | 4/2004 |
| JP | 2004-219804 | 8/2004 |
| JP | 2006-154819 | 6/2006 |

* cited by examiner

*Primary Examiner*—Abul Azad
(74) *Attorney, Agent, or Firm*—Blakely, Sokoloff, Taylor & Zafman LLP

(57) ABSTRACT

A voice/music determining apparatus is configured to calculate first feature parameters for discriminating between a voice signal and a musical signal; and calculate second feature parameters for discriminating between a musical signal and a background-sound-superimposed voice signal. A first score is calculated to indicate likelihood that the input audio signal is a voice signal or a musical signal as a sum of weight-multiplied first feature parameters. A second score is calculated to indicate likelihood that the input audio signal is a musical signal or a background-sound-superimposed voice signal as a sum of weight-multiplied second feature parameters. It is determined whether the input audio signal is a voice signal or a musical signal on the basis of the first score. Further, it is determined whether the musical signal is the input audio signal is a background-sound-superimposed voice signal on the basis of the second score.

5 Claims, 7 Drawing Sheets

VOICE/MUSIC DETERMINING APPARATUS AND METHOD

CROSS-REFERENCE TO RELATED APPLICATIONS

This application is based upon and claims the benefit of priority from Japanese Patent Application No. 2008-174698, filed Jul. 3, 2008, the entire contents of which are incorporated herein by reference.

BACKGROUND

1. Field

The present invention relates to a voice/music determining apparatus and method for quantitatively determining proportions of a voice signal and a musical signal that are contained in an audio (audible frequency) signal to be played back.

2. Description of Related Art

As is well known, sound quality correction processing is often used for increasing sound quality in an equipment, such as a broadcast receiver for TV broadcasts, or an information playing-back equipment for playing back recorded information on an information recording media, in reproducing an audio signal such as a received broadcast signal, and a signal read from an information recording medium.

In this case, what is performed in the sound quality correction processing on the audio signal differs, depending on whether the audio signal is a voice signal of a human voice or a musical (non-voice) signal, such as a music tune. More specifically, as for a voice signal, the sound quality correction processing should be performed so as to emphasize and clarify center-located components as in the case of a talk scene, a sport running commentary, etc. As for a musical signal, the sound quality correction processing should be performed so as to emphasize a stereophonic sense and provide necessary extensity.

To this end, in current equipment, it is determined whether an acquired audio signal is a voice signal or a musical signal so that a suitable sound quality correction is performed according to such a determination result. However, an actual audio signal in many cases contains a voice signal and a musical signal in mixture and it is difficult to make discrimination between them. At present, it does not appear that proper sound quality correction processing is necessarily performed on audio signals.

JP-A-7-13586 discloses a configuration in which an input acoustic signal is determined as a voice if its consonant nature, voicelessness, and power variation are higher than given threshold values. The input acoustic signal is determined as music if its voicelessness and power variation are lower than the given threshold values, and is determined as indefinite in otherwise cases.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, a voice/music determining apparatus includes: a first feature calculating module configured to calculate first feature parameters for discriminating between a voice signal and a musical signal from an input audio signal; a second feature calculating module configured to calculate second feature parameters for discriminating between a musical signal and a background-sound-superimposed voice signal from the input audio signal; a first score calculating module configured to calculate a first score indicating a likelihood that the input audio signal is a voice signal or a musical signal, the first score obtained by multiplying the first feature parameters by respective weights that are calculated in advance on the basis of learned parameter values of voice/music reference data and adding up weight-multiplied first feature parameters; a second score calculating module configured to calculate a second score indicating a likelihood that the input audio signal is a musical signal or a background-sound-superimposed voice signal, the second score obtained by multiplying the second feature parameter by respective weights that are calculated in advance on the basis of learned parameter values of music/background sound reference data and adding up weight-multiplied second feature parameters; and a voice/music determining module configured to determine whether the input audio signal is a voice signal or a musical signal on the basis of the first score; wherein the voice/music determining module determines whether the input audio signal is a background-sound-superimposed voice signal or not on the basis of the second score, when the input audio signal is determined as a musical signal.

Figure 1:
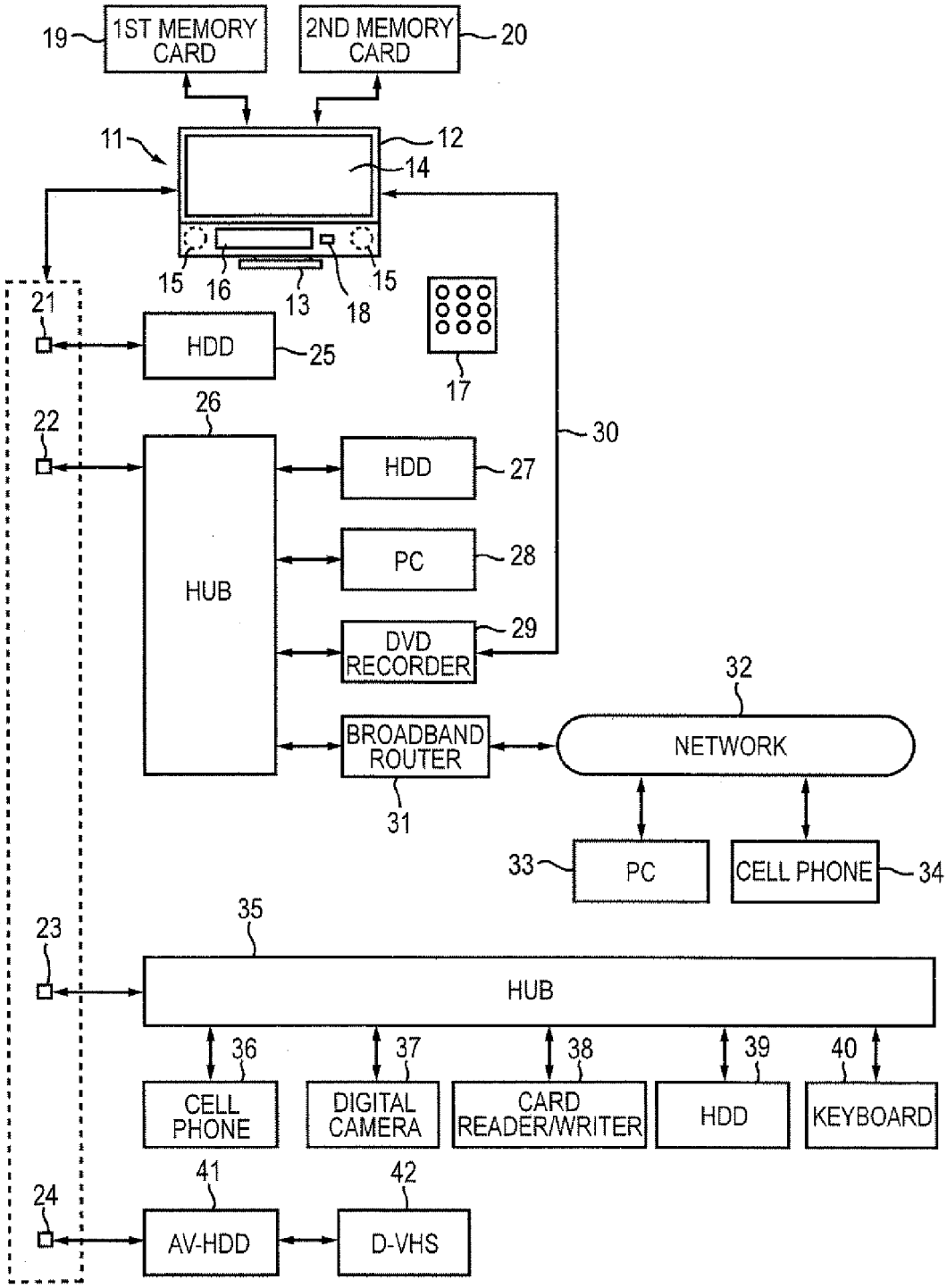
FIG. 1 shows an embodiment and schematically illustrates a digital TV broadcast receiver and an example network system centered by it.

An embodiment of the present invention will be hereinafter described in detail with reference to the drawings. FIG. 1 schematically shows an appearance of a digital TV broadcast receiver 11 to be described in the embodiment and an example network system centered by the digital TV broadcast receiver 11

The digital TV broadcast receiver 11 mainly includes a thin cabinet 12 and a stage 13 which supports the cabinet 12 erected. The cabinet 12 is equipped with a flat panel video display device 14 such as a surface-conduction electron-emitter display (SED) panel or a liquid crystal display panel, a pair of speakers 15, a manipulation unit 16, a light-receiving unit 18 for receiving manipulation information that is transmitted from a remote controller 17, and other components.

The digital TV broadcast receiver 11 is configured so that a first memory card 19 such as a secure digital (SD) memory card, a multimedia card (MMC), or a memory stick can be inserted into and removed from it and that such information as a broadcast program or a photograph can be recorded in and reproduced from the first memory card 19.

Furthermore, the digital TV broadcast receiver 11 is configured so that a second memory card (integrated circuit (IC) card or the like) 20 that is stored with contract information, for example, can be inserted into and removed from it and that information can be recorded in and reproduced from the second memory card 20.

The digital TV broadcast receiver 11 is equipped with a first LAN terminal 21, a second LAN terminal 22, a USB terminal 23, and an IEEE 1394 terminal 24.

Among these terminals, the first LAN terminal 21 is used as a port which is dedicated to a LAN-compatible hard disk drive (HDD). That is, the first LAN terminal 21 is used for recording and reproducing information in and from the LAN-compatible HDD 25 which is a network attached storage (NAS) connected to the first LAN terminal 21, by Ethernet (registered trademark).

Since as mentioned above the digital TV broadcast receiver 11 is equipped with the first LAN terminal 21 as a port dedicated to a LAN-compatible HDD, information of a broadcast program having Hi-Vision image quality can be recorded stably in the HDD 25 without being influenced by the other part of the network environment, a network use situation, etc.

The second LAN terminal 22 is used as a general LAN-compatible port using Ethernet. That is, the second LAN terminal 22 is used for constructing, for example, a home network by connecting such equipment as a LAN-compatible HDD 27, a PC (personal computer) 28, and an HDD-incorporated DVD (digital versatile disc) recorder 29 to the digital TV broadcast receiver 11 via a hub 26 and allowing the digital TV broadcast receiver 11 to exchange information with these apparatus.

Each of the PC 28 and the DVD recorder 29 is configured as a UPnP (universal plug and play)-compatible apparatus which has functions necessary to operate as a content server in a home network and provides a service of providing URI (uniform resource identifier) information which is necessary for access to content.

The DVD recorder 29 is provided with a dedicated analog transmission line 30 to be used for exchanging analog video and audio information with the digital TV broadcast receiver 11, because digital information that is communicated via the second LAN terminal 22 is control information only.

Furthermore, the second LAN terminal 22 is connected to an external network 32 such as the Internet via a broadband router 31 which is connected to the hub 26. The second LAN terminal 22 is also used for exchanging information with a PC 33, a cell phone 34, etc. via the network 32.

The USB terminal 23 is used as a general USB-compatible port. For example, the USB terminal 23 is used for connecting USB devices such as a cell phone 36, a digital camera 37, a card reader/writer 38 for a memory card, an HDD 39, and a keyboard 40 to the digital TV broadcast receiver 11 via a hub 35 and thereby allowing the digital TV broadcast receiver 11 to exchange information with these devices.

For example, the IEEE 1394 terminal 24 is used for connecting plural serial-connected information recording/reproducing apparatus such as an AV-HDD 41 and a D (digital)-VHS (video home system) recorder 42 to the digital TV broadcast receiver 11 and thereby allowing the digital TV broadcast receiver 11 to exchange information with these apparatus selectively.

Figure 2:
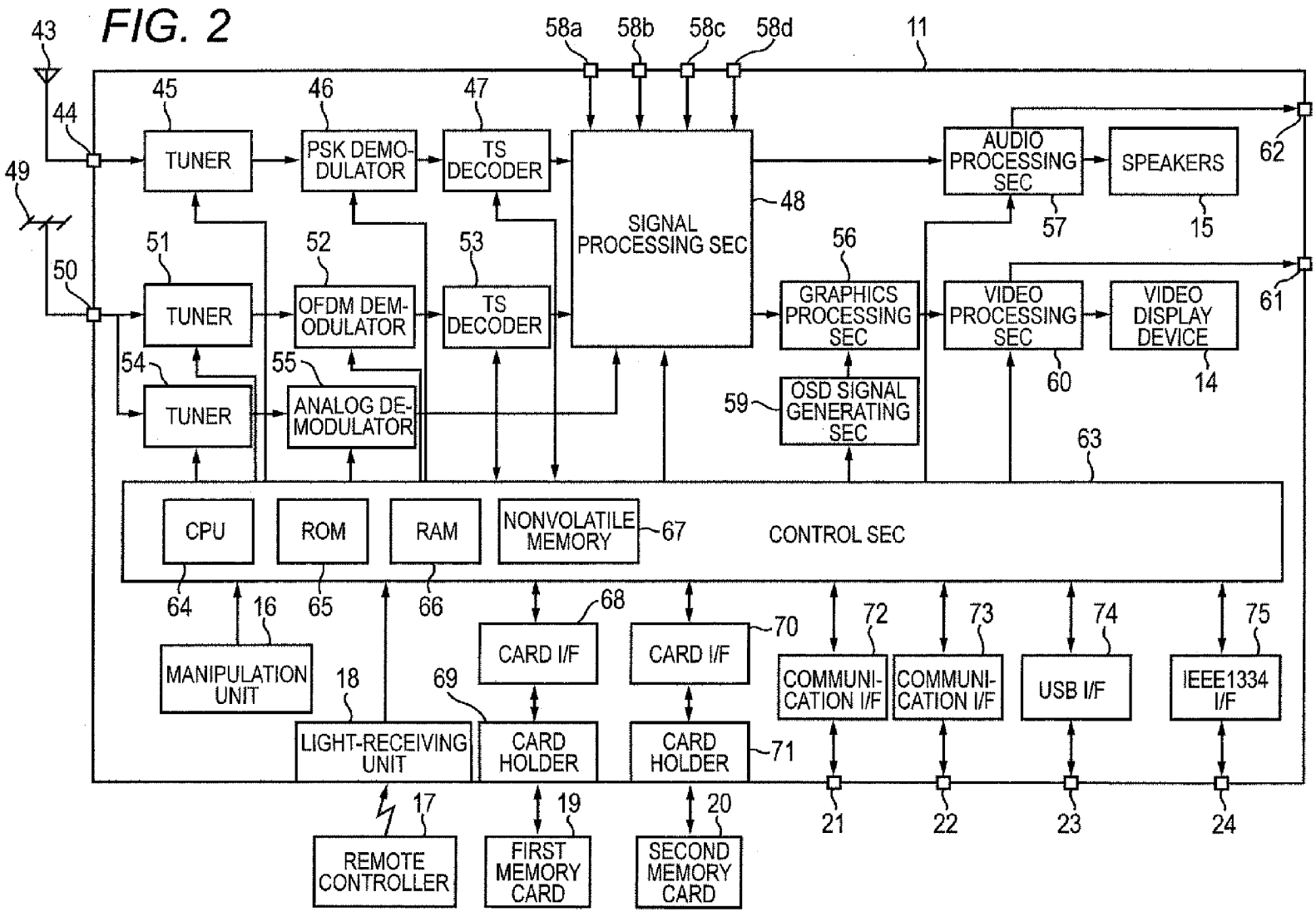
FIG. 2 is a block diagram of a main signal processing system of the digital TV broadcast receiver according to the embodiment.

FIG. 2 shows a main signal processing system of the digital TV broadcast receiver 11. A satellite digital TV broadcast signal received by a broadcasting satellite/communication satellite (BS/CS) digital broadcast receiving antenna 43 is supplied to a satellite broadcast tuner 45 via an input terminal 44, whereby a broadcast signal on a desired channel is selected.

The broadcast signal selected by the tuner 45 is supplied to a PSK (phase shift keying) demodulator 46 and a TS (transport stream) decoder 47 in this order and thereby demodulated into a digital video signal and audio signal, which are output to a signal processing section 48.

A ground-wave digital TV broadcast signal received by a ground-wave broadcast receiving antenna 49 is supplied to a ground-wave digital broadcast tuner 51 via an input terminal 50, whereby a broadcast signal on a desired channel is selected.

In Japan, for example, the broadcast signal selected by the tuner 51 is supplied to an OFDM (orthogonal frequency division multiplexing) demodulator 52 and a TS decoder 53 in this order and thereby demodulated into a digital video signal and audio signal, which are output to the above-mentioned signal processing section 48.

A ground-wave analog TV broadcast signal received by the above-mentioned ground-wave broadcast receiving antenna 49 is supplied to a ground-wave analog broadcast tuner 54 via the input terminal 50, whereby a broadcast signal on a desired channel is selected. The broadcast signal selected by the tuner 54 is supplied to an analog demodulator 55 and thereby demodulated into an analog video signal and audio signal, which are output to the above-mentioned signal processing section 48.

The signal processing section 48 performs digital signal processing on a selected one of the sets of a digital video signal and audio signal that are supplied from the respective TS decoders 47 and 53 and outputs the resulting video signal and audio signal to a graphics processing section 56 and an audio processing section 57, respectively.

Plural (in the illustrated example, four) input terminals 58*a*, 58*b*, 58*c*, and 58*d* are connected to the signal processing section 48. Each of the input terminals 58*a*-58*d* allows input of an analog video signal and audio signal from outside the digital TV broadcast receiver 11.

The signal processing section 48 selectively digitizes sets of an analog video signal and audio signal that are supplied from the analog demodulator 55 and the input terminals 58*a*-58*d*, performs digital signal processing on the digitized video signal and audio signal, and outputs the resulting video signal and audio signal to the graphics processing section 56 and the audio processing section 57, respectively.

The graphics processing section 56 has a function of superimposing an OSD (on-screen display) signal generated by an OSD signal generating section 59 on the digital video signal supplied from the signal processing section 48, and outputs the resulting video signal. The graphics processing section 56 can selectively output the output video signal of the signal processing section 48 and the output OSD signal of the OSD signal generating section 59 or output the two output signals in such a manner that each of them occupies a half of the screen.

The digital video signal that is output from the graphics processing section 56 is supplied to a video processing section 60. The video processing section 60 converts the received digital video signal into an analog video signal having such a format as to be displayable by the video display device 14, and outputs it to the video display device 14 to cause the video display device 14 to perform video display. The analog video signal is also output to the outside via an output terminal 61.

The audio processing section 57 performs sound quality correction processing (described later) on the received digital audio signal and converts the thus-processed digital audio signal into an analog audio signal having such a format as to be reproducible by the speakers 15. The analog audio signal is output to the speakers 15 and used for audio reproduction and is also output to the outside via an output terminal 62.

In the digital TV broadcast receiver 11, a control section 63 controls, in a unified manner, all operations including the above-described various receiving operations. Incorporating a central processing unit (CPU) 64, the control section 63 receives manipulation information from the manipulation unit 16 or manipulation information sent from the remote controller 17 and received by the light-receiving unit 18 and controls the individual sections so that the manipulation is reflected in their operations.

In doing so, the control section 63 mainly uses a read-only memory (ROM) 65 which is stored with control programs to be run by the CPU 64, a random access memory (RAM) 66 which provides the CPU 64 with a work area, and a nonvolatile memory 67 for storing various kinds of setting information, control information, etc.

The control section 63 is connected, via a card I/F (interface) 68, to a card holder 69 into which the first memory card 19 can be inserted. As a result, the control section 63 can exchange, via the card I/F 68, information with the first memory card 19 being inserted in the card holder 69.

The control section 63 is connected, via a card I/F 70, to a card holder 71 into which the second memory card 20 can be inserted. As a result, the control section 63 can exchange, via the card I/F 70, information with the second memory card 20 being inserted in the card holder 71.

The control section 63 is connected to the first LAN terminal 21 via a communication I/F 72. As a result, the control section 63 can exchange, via the communication I/F 72, information with the LAN-compatible HDD 25 which is connected to the first LAN terminal 21. In this case, the control section 63 has a dynamic host configuration protocol (DHCP) server function and controls the LAN-compatible HDD 25 connected to the first LAN terminal 21 by assigning it an IP (Internet protocol) address.

The control section 63 is also connected to the second LAN terminal 22 via a communication I/F 73. As a result, the control section 63 can exchange, via the communication I/F 73, information with the individual apparatus (see FIG. 1) that are connected to the second LAN terminal 22.

The control section 63 is also connected to the USB terminal 23 via a USB I/F 74. As a result, the control section 63 can exchange, via the USB I/F 74, information with the individual devices (see FIG. 1) that are connected to the USB terminal 23.

Furthermore, the control section 63 is connected to the IEEE 1394 terminal 24 via an IEEE 1394 I/F 75. As a result, the control section 63 can exchange, via the IEEE 1394 I/F 75, information with the individual apparatus (see FIG. 1) that are connected to the IEEE 1394 terminal 24.

Figure 3:
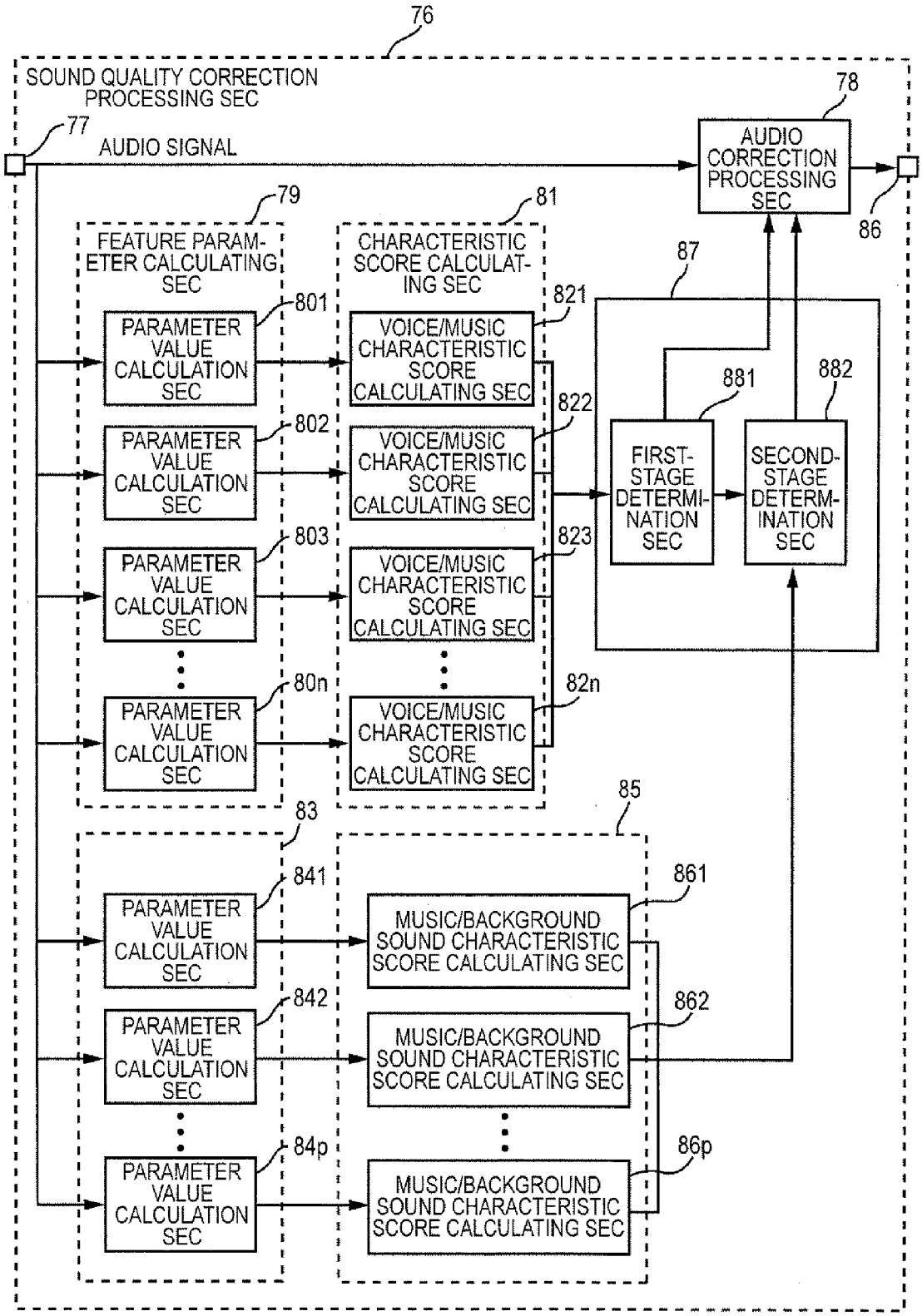
FIG. 3 is a block diagram of a sound quality correction processing section which is incorporated in an audio processing section of the digital TV broadcast receiver according to the embodiment.

FIG. 3 shows a sound quality correction processing section 76 which is provided in the audio processing section 57. In the sound quality correction processing section 76, an audio signal (e.g., a pulse code modulation (PCM) signal) that is supplied, via an input signal 77, to each of an audio correction processing section 78, a voice/music determination feature parameter calculating section 79, and a music/background sound determination feature parameter calculating section 83.

In the voice/music determination feature parameter calculating section 79, the received audio signal is supplied to plural (in the illustrated example, n) parameter value calculation sections 801, 802, 803, . . . , 80*n*. In the music/background sound determination feature parameter calculating section 83, the received audio signal is supplied to plural (in the illustrated example, p) parameter value calculation sections 841, 842, . . . , 84*p*. Each of the parameter value calculation sections 801-80*n* and 841-84*p* calculates, on the basis of the received audio signal, a feature parameter to be used for discriminating between a voice signal and a musical signal or a feature parameter to be used for discriminating between a musical signal and a background-sound-superimposed voice signal.

Figures 4A, 4B:
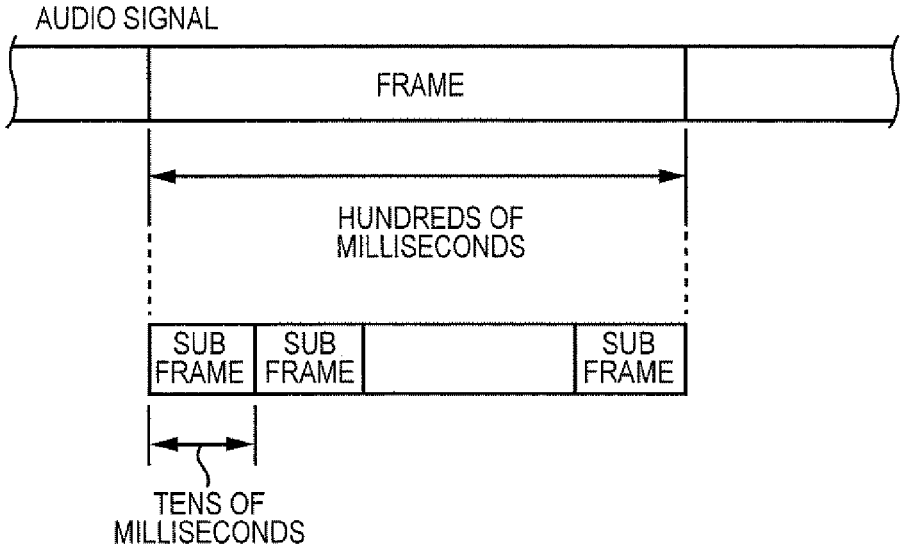
FIGS. 4A and 4B are charts illustrating operation of each feature parameter calculation section which is incorporated in the sound quality correction processing section according to the embodiment.

More specifically, in each of the parameter value calculation sections 801-80*n* and 841-84*p*, the received audio signal is cut into frames of hundreds of milliseconds (see FIG. 4A) and each frame is divided into subframes of tens of milliseconds (see FIG. 4B).

Each of the parameter value calculation sections 801-80*n* and 841-84*p* generates a feature parameter by calculating, from the audio signal, on subframe basis, discrimination information data for discriminating between a voice signal and a musical signal or discrimination information data for discriminating between a musical signal and a background-sound-superimposed voice signal and calculating a statistical quantity such as an average or a variance from the discrimination information data for each frame.

For example, the parameter value calculation section 801 generates a feature parameter pw by calculating, as discrimination information data, on subframe basis, power values which are the sums of the squares of amplitudes of the input audio signal and calculating a statistical quantity such as an average or a variance from the power values for each frame.

The parameter value calculation section 802 generates a feature parameter zc by calculating, as discrimination information data, on subframe basis, zero cross frequencies which are the numbers of times the temporal waveform of the input audio signal crosses zero in the amplitude direction and calculating a statistical quantity such as an average or a variance from the zero cross frequencies for each frame.

The parameter value calculation section 803 generates a feature parameter "lr" by calculating, as discrimination information data, on subframe basis, power ratios (LR power ratios) between 2-channel stereo left and right (L and R) signals of the input audio signal and calculating a statistical quantity such as an average or a variance from the power ratios for each frame.

Likewise, the parameter value calculation section 841 calculates, on subframe basis, the degrees of concentration of power components in a particular frequency band characteristic of sound of a musical instrument used for a tune after converting the input audio signal into the frequency domain. For example, the degree of concentration is represented by a power occupation ratio of a low-frequency band in the entire band or a particular band. The parameter value calculation section 841 generates a feature parameter "inst" by calculating a statistical quantity such as an average or a variance from these pieces of discrimination information for each frame.

Figure 5:
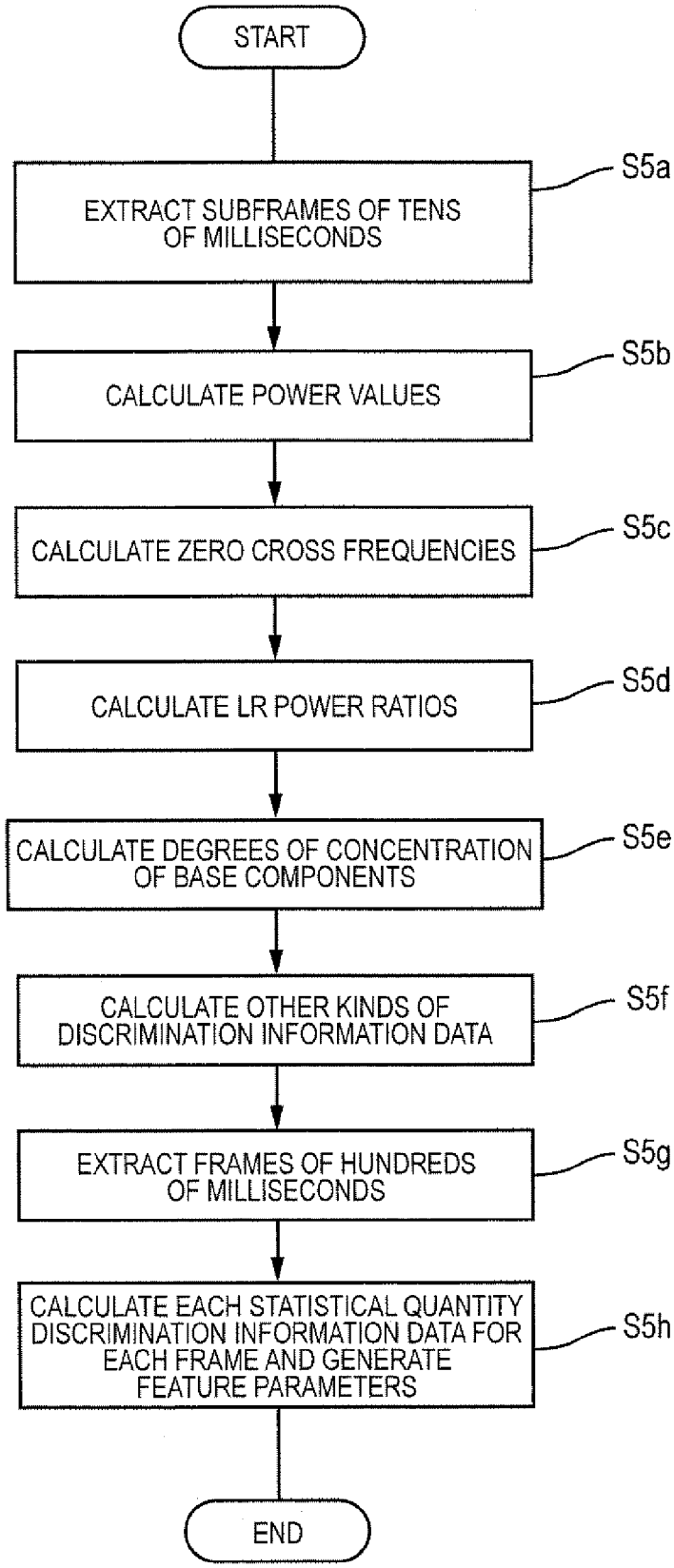
FIG. 5 is a flowchart of a feature parameter calculation process according to the embodiment.

FIG. 5 is a flowchart of an example process according to which the voice/music determination feature parameter calculating section 79 and the music/background sound determination feature parameter calculating section 83 generate, from an input audio signal, various feature parameters to be used for discriminating between a voice signal and a musical signal and various feature parameters to be used for discriminating between a musical signal and a background-sound-superimposed voice signal. More specifically, upon a start of the process, at step S5*a*, each of the parameter value calculation sections 801-80*n* of the voice/music determination feature parameter calculating section 79 extracts subframes of tens of milliseconds from an input audio signal. Each of the parameter value calculation sections 841-84*p* of the music/background sound determination feature parameter calculating section 83 performs the same processing.

At step S5*b*, the parameter value calculation section 801 of the voice/music determination feature parameter calculating section 79 calculates power values from the input audio signal on subframe basis. At step S5*c*, the parameter value calculation section 802 calculates zero cross frequencies from the input audio signal on subframe basis. At step S5*d*, the parameter value calculation section 803 calculates LR power ratios from the input audio signal on subframe basis.

At step S5*e*, the parameter value calculation section 841 of the music/background sound determination feature parameter calculating section 83 calculates the degrees of concentration of particular frequency components of a musical instrument from the input audio signal on subframe basis.

Likewise, at step S5*f*, the other parameter value calculation sections 804-80*n* of the voice/music determination feature parameter calculating section 79 calculate other kinds of discrimination information data from the input audio signal on subframe basis. At step S5*g*, each of the parameter value calculation sections 801-80*n* of the voice/music determination feature parameter calculating section 79 extracts frames of hundreds of milliseconds from the input audio signal. At steps S5*f* and S5*g*, the other parameter value calculation sections 842-84*p* of the music/background sound determination feature parameter calculating section 83 perform the same kinds of processing.

At step S5*h*, each of the parameter value calculation sections 801-80*n* of the voice/music determination feature parameter calculating section 79 and the parameter value calculation sections 841-84*p* of the music/background sound determination feature parameter calculating section 83 generates a feature parameter by calculating, for each frame, a statistical quantity such as an average or a variance from the pieces of discrimination information that were calculated on subframe basis. Then, the process is finished.

The feature parameters generated by the parameter value calculation sections 801-80*n* of the voice/music determination feature parameter calculating section 79 are supplied to voice/music characteristic score calculating sections 821, 822, 823, . . . , 80*n* which are provided in a characteristic score calculating section 81 so as to correspond to the respective parameter value calculation sections 801-80*n*. The feature parameters generated by the parameter value calculation sections 841-84*p* of the music/background sound determination feature parameter calculating section 83 are supplied to music/background sound characteristic score calculating sections 861, 862, . . . , 86*p* which are provided in a characteristic score control section 85 so as to correspond to the respective parameter value calculation sections 841-84*p*.

On the basis of the feature parameters supplied from the corresponding parameter value calculation sections 801-80*n*, the voice/music characteristic score calculating sections 821-82*n* calculate a score S1 which quantitatively indicates whether the characteristics of the audio signal being supplied to the input terminal 77 is close to those of a voice signal such as a speech or a musical (tune) signal.

Likewise, on the basis of the feature parameters supplied from the corresponding parameter value calculation sections 841-84*p*, the voice/music characteristic score calculating sections 861-86*p* calculate a score S2 which quantitatively indicates whether the characteristics of the audio signal being supplied to the input terminal 77 is close to those of a musical signal or a voice signal on which background sound is superimposed.

Before description of a specific score calculation method, properties of each feature parameter will be described. For example, as described above, a feature parameter "pw" corresponding to a power variation is supplied to the voice/music characteristic score calculating section 821. In general, as for the power variation, utterance periods and silent periods appear alternately in a voice. Therefore, there is a tendency that the signal power varies to a large extent between subframes and the variance of power values of subframes is large in each frame. The term "power variation" as used herein means a feature quantity indicating how the power value calculated in each subframe varies over a longer period, that is, a frame. Specifically, the power variation is represented by a power variance or the like.

As described above, a feature parameter "zc" corresponding to zero cross frequencies is supplied to the voice/music characteristic score calculating section 822. As for the zero cross frequency, in addition to the above difference between utterance periods and silent periods, a voice has a tendency that the variance of zero cross frequencies of subframes is large in each frame because the zero cross frequency of a voice signal is high for consonants and low for vowels.

As described above, a feature parameter "lr" corresponding to LR power ratios is supplied to the voice/music characteristic score calculating section 823. As for the LR power ratio, a musical signal has a tendency that the power ratio between the left and right channels is large because in many cases performances of musical instruments other than a vocalist performance are localized at positions other than the center.

As such, parameters that facilitate discrimination between a voice signal and a musical signal are selected as the parameters to be calculated by the voice/music determination feature parameter calculating section 79 paying attention to the properties of these signal types.

Although the above parameters are effective in discriminating between a pure musical signal and a pure voice signal, they are not necessarily so effective for a voice signal on which background sound such as clapping sound/cheers, laughter, or sound of a crowd is superimposed; influenced by the background sound: Such a signal tends to be determined erroneously to be a musical signal. To suppress such erroneous determination, the music/background sound determination feature parameter calculating section 83 employs feature parameters that are suitable for discrimination between such a superimposition signal and a musical signal.

More specifically, as described above, a feature parameter "inst" corresponding to the degrees of concentration of particular frequency components of a musical instrument is supplied to the music/background sound characteristic score calculating section 861. In many cases, for each of musical instruments used for a tune, the amplitude power is concentrated in a particular frequency band. For example, modern tunes in many cases employ an instrument for base sound. An analysis of base sound shows that the amplitude power is concentrated in a particular low-frequency band in the signal frequency domain. On the other hand, a superimposition signal as mentioned above does not exhibit such power concentration in a particular low-frequency band. Therefore, this parameter can serve as an index that is effective in discriminating between a musical signal and a background-sound-superimposed signal.

However, this parameter is not necessarily effective in discriminating between a musical signal and a voice signal on which background sound is not superimposed. That is, directly using this parameter as a parameter for discrimination between a voice signal and a musical signal may increase erroneous detections because a relatively high degree of concentration may occur in the particular frequency band even in the case of an ordinary voice. On the other hand, when background sound such as clapping sound or cheers is superimposed on a voice, in general a resulting sound signal has large medium to high-frequency components and a relatively low degree of concentration of base components. This parameter is thus effective when applied to a signal that has once been determined a musical signal by means of the above-mentioned voice/music determination feature parameters.

As described above, it is desirable to select a set of feature parameters properly according to signal types to be discriminated from each other by the two-stage determining method. Although the above example employs a base instrument, any instrument may be used for this purpose.

A description will now be made of the scores S1 and S2 which are calculated by the voice/music characteristic score calculating section 81 and the music/background sound characteristic score calculating section 85, respectively.

A calculation method using a linear discrimination function will be described below though the method for calculating scores S1 and S2 is not limited to one method. In the method using a linear discrimination function, weights by which parameter values that are necessary for calculation of scores S1 and S2 are to be multiplied are calculated by offline learning. The weights are set so as to be larger for parameters that are more effective in signal type discrimination, and are calculated by inputting reference data to serve as standard data and learning its feature parameter values. Now, a set of input parameters of a "k"th frame of learning subject data is represented by a vector x (Equation (1)) and signal intervals {music, voice} to which the input belongs are represented by y (Equation (2)):

$$x^k=(1, x_1^k, x_2^k, \ldots, x_n^k) \tag{1}$$

$$y^k=\{-1, +1\} \tag{2}$$

The components of the vector of Equation (1) correspond to n feature parameters, respectively. The values "−1" and "+1" in Equation (2) correspond to a music interval and a voice interval, that is, intervals of correct signal types of voice/music reference data used are manually labeled binarily in advance. The following linear discrimination function is established from Equation (1):

$$f(x)=\beta_0+\beta_1x_1+\beta_2x_2+\ldots+\beta_nx_n \tag{3}$$

The weights β of the respective parameters are determined by extracting vectors x for k=1 to N (N: the number of input frames of the reference data) and solving normal equations so that the sum (Equation (4)) of the squares of errors of evaluation value of Equation (3) from the correct signal type (Equation (2)):

$$Esum=\sum_{k=1}^{N}\{y^k-f(x^k)\}^2 \tag{4}$$

Evaluation values of data to be subjected to discrimination actually are calculated according to Equation (3) using the weights that were determined by the learning. The data is determined as belonging to a voice interval if f(x)>0 and a music interval if f(x)<0. The f(x) thus calculated corresponds to a score S1. Weights by which parameters that are suitable for discrimination between a musical signal and a background-sound-superimposed voice signal are to be multiplied are determined by performing the above learning for music/background sound reference data. A score S2 is calculated by multiplying feature parameter values of actual discrimination data by the thus-determined weights.

The method for calculating a score is not limited to the above-described method in which feature parameter values are multiplied by weights that are determined by offline learning using a linear discrimination function. For example, the invention is applicable to a method in which a score is calculated by setting empirical threshold values for respective parameter calculation values and giving weighted points to the parameters according to results of comparison with the threshold values, respectively.

The score S1 that has been generated by the voice/music characteristic score calculating sections 821-82*n* of the voice/music characteristic score calculating section 81 and the score S2 that has been generated by the music/background sound characteristic score calculating sections 861-86*p* of the music/background sound characteristic score calculating section 85 are supplied to the voice/music determining section 87. The voice/music determining section 87 determines whether the input audio signal is a voice signal or a musical signal on the basis of the voice/music characteristic score S1 and the music/background sound characteristic score S2.

The voice/sound determining section 87 has a two-stage configuration that consists of a first-stage determination section 881 and a second-stage determination section 882.

The first-stage determination section 881 determines whether the input audio signal is a voice signal or a musical signal on the basis of the score S1. According to the above-described score calculation method by learning, the input audio signal is determined a voice signal if S1>0 and a musical signal if S1<0. If the input audio signal is determined a voice signal, this decision is finalized.

If S1<0, a second-stage determination is made further by the second-stage determining section 882.

Even if a determination result "musical signal" is produced by the first stage, this determination may be wrong. The two-stage determination is performed to increase the reliability of the signal discrimination. In particular, if any of various kinds of background sound such as clapping sound/cheers, laughter, and sound of a crowd, which occur at a high frequency in program content, is superimposed on a voice, the voice signal tends to be determined erroneously to be a musical signal. To suppress erroneous determination due to superimposition of background sound, the second-stage determination section 882 determines, on the basis of the score S2, whether the input audio signal is really a musical signal or is a voice signal on which background sound is superimposed.

In the above determination using a linear discrimination function, {music, background-sound-superimposed voice} are used as signal intervals for learning reference data and are assigned {−1, +1}. If the score S2 that has been calculated by multiplying the parameter values by the thus-determined weights is smaller than 0, a determination result "musical signal" is finalized. If S2>0, the input audio signal is determined a background-sound-superimposed voice signal.

As described above, to increase the robustness against a background-sound-superimposed voice signal which tends to cause an erroneous determination, the two-stage determination is performed by the first-stage determination section 881 and the second-stage determination section 882 on the basis of characteristic scores S1 and S2 each of which is calculated using parameter weights that are determined in advance by, for example, processing of learning reference data and solving normal equations established using a linear discrimination function.

Figure 6:
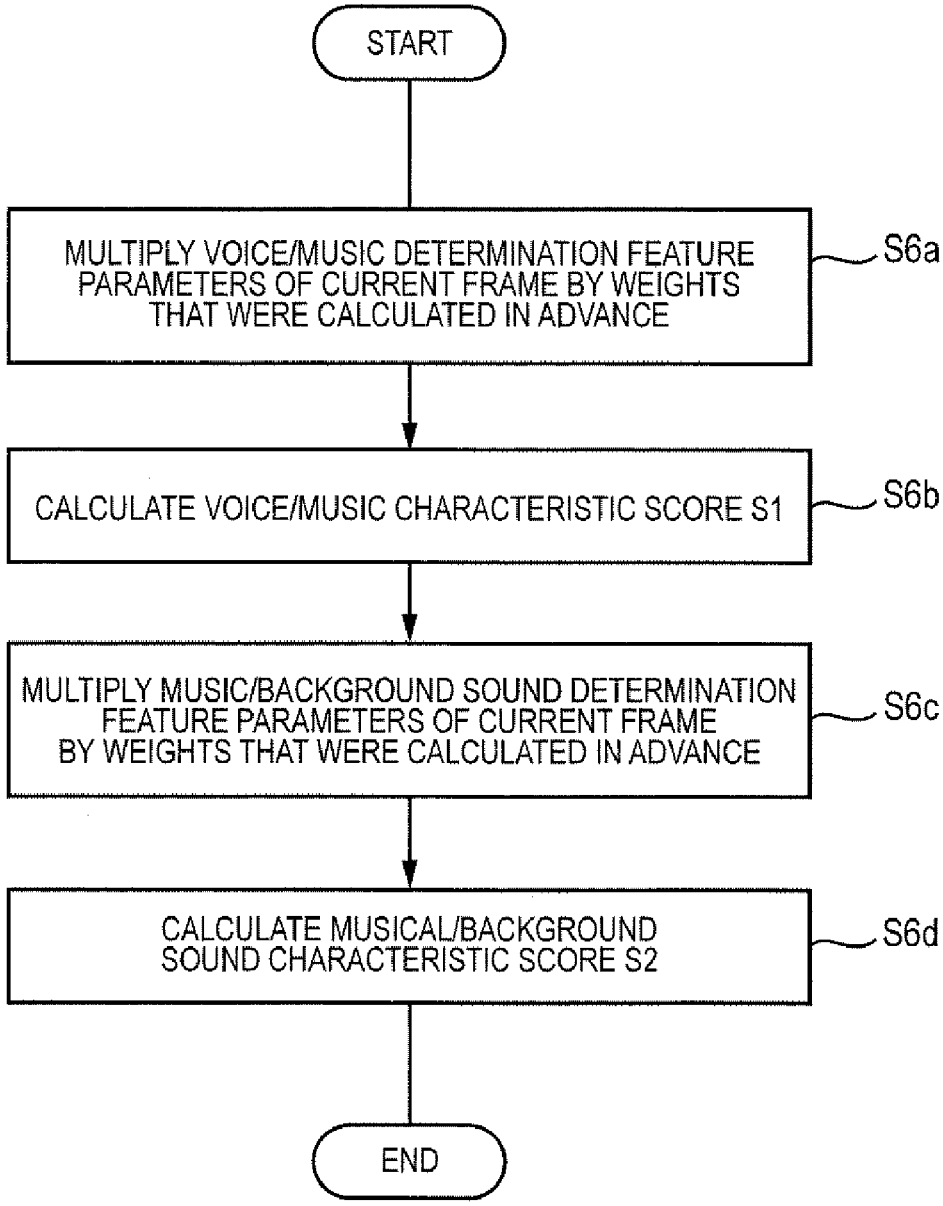
FIG. 6 is a flowchart of a process executed by characteristic score calculating sections that are incorporated in the sound quality correction processing section according to the embodiment.

FIG. 6 is a flowchart of an example process that the voice/music characteristic score calculating section 81 and the music/background sound characteristic score calculating section 85 calculate a voice/music characteristic score S1 and a music/background sound characteristic score S2, respectively, on the basis of parameter weights that were calculated in the above-described manner by offline learning using a linear discrimination function.

Figure 7:
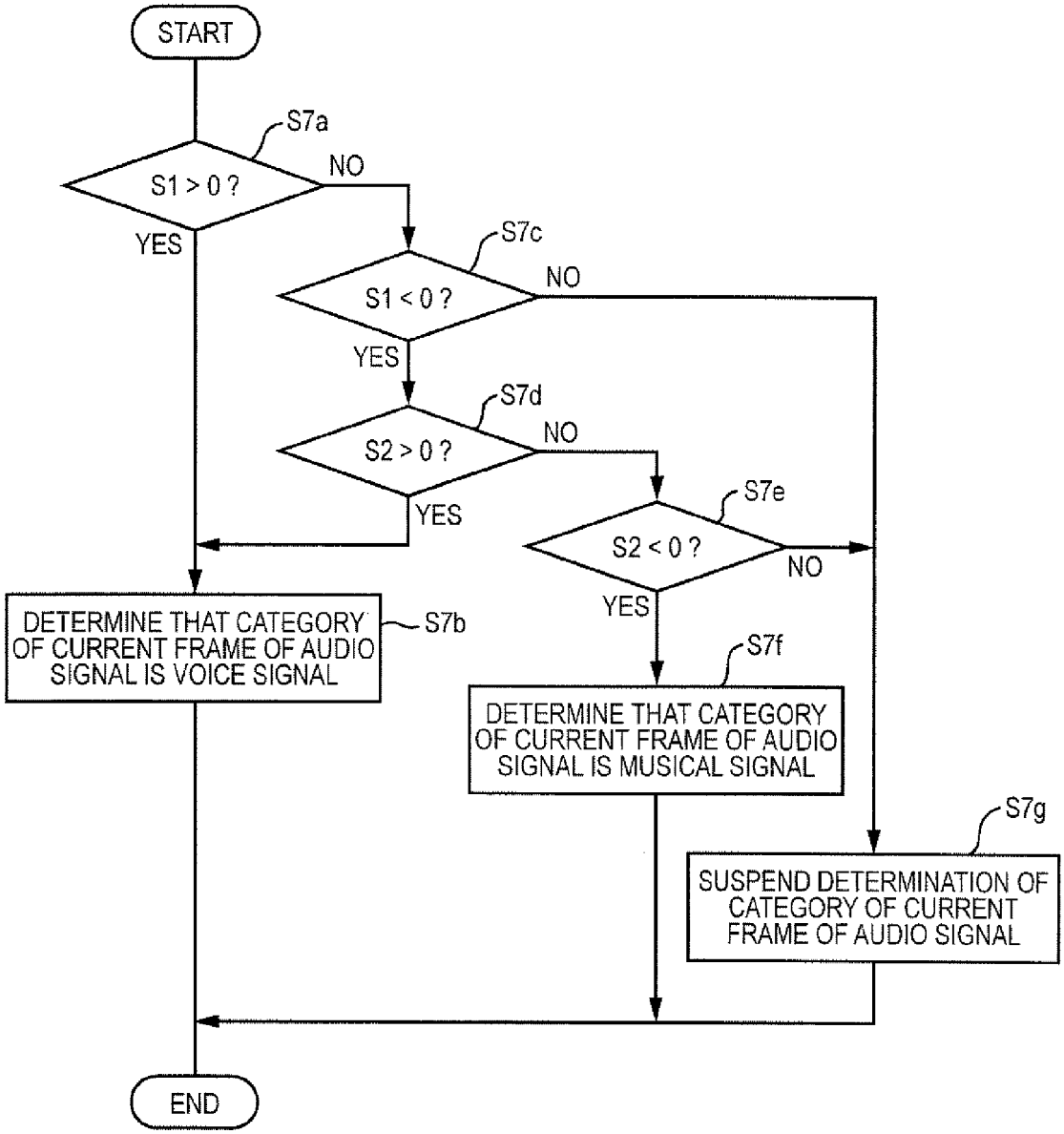
FIG. 7 is a flowchart of a process executed by a voice/music determining section which is incorporated in the sound quality correction processing section according to the embodiment.

FIG. 7 is a flowchart of an example process that the voice/music determining section 87 discriminates between a voice signal and a musical signal on the basis of a voice/music characteristic score S1 and a music/background sound characteristic score S2 that are supplied from the voice/music characteristic score calculating section 81 and the music/background sound characteristic score calculating section 85, respectively.

Upon a start of the process of FIG. 6, at step S6*a*, the voice/music characteristic score calculating section 81 multiplies feature parameters calculated by the voice/music determination characteristic parameter calculating section 79 by weights that were determined in advance on the basis of learned parameter values of voice/music reference data. At step S6*b*, the voice/music characteristic score calculating section 81 generates a score S1 which represents a likelihood that the input audio signal is a voice signal or a musical signal by adding up the weight-multiplied feature parameter values.

At step S6*c*, the music/background sound characteristic score calculating section 85 multiplies feature parameters calculated by the music/background sound determination characteristic parameter calculating section 83 by weights that were determined in advance on the basis of learned parameter values of music/background sound reference data. At step S6*d*, the music/background sound characteristic score calculating section 85 generates a score S2 which represents a likelihood that the input audio signal is a musical signal or a background-sound-superimposed voice signal by adding up the weight-multiplied feature parameter values. Then, the process is finished.

Next, in the voice/music determining section 87, upon a start of the process of FIG. 7, at step S7*a*, the first-stage determination section 881 checks the value of the voice/music characteristic score S1. If S1>0, at step S7*b*, the first-stage determination section 881 determines that the signal type of the current frame of the input audio signal is a voice signal. If not, at step S7*c* the first-stage determination section 881 determines whether the score S1 is smaller than 0. If the relationship S1<0 is not satisfied, at step S7*g* the first-stage determination section 881 suspends the determination of the signal type of the current frame of the input audio signal and determines that the signal type of the immediately preceding frame is still effective. If S1<0, at step S7*d* the second-stage determination section 882 checks the value of the music/background sound characteristic score S2. If S2>0, at step S7*b* the second-stage determination section 882 determines that the signal type of the current frame of the input audio signal is a voice signal on which background sound is superimposed. If not, at step S7*e* the second-stage determination section 882 determines whether the score S2 is smaller than 0. If the relationship S2<0 is not satisfied, at step S7*g* the second-stage determination section 882 suspends the determination of the signal type of the current frame of the input audio signal and determines that the signal type of the immediately preceding frame is still effective. If S2<0, at step S7*f* the second-stage determination section 882 determines that the signal type of the current frame of the input audio signal is a musical signal.

The thus-produced determination result of the voice/music determining section 87 is supplied to the audio correction processing section 78. The audio correction processing section 78 performs sound quality correction processing corresponding to the determination result of the voice/music determining section 87 on the input audio signal being supplied to the input terminal 77, and outputs a resulting audio signal from an output terminal 95.

More specifically, if the determination result of the voice/music determining section 87 is "voice signal," the audio correction processing section 78 performs sound quality correction processing on the input audio signal so as to emphasize and clarify center-localized components. If the determination result of the voice/music determining section 87 is "musical signal," the audio correction processing section 78 performs sound quality correction processing on the input audio signal so as to emphasize a stereophonic sense and provide necessary extensity.

The invention is not limited to the above embodiment itself and in a practice stage the invention can be implemented by modifying constituent elements in various manners without departing from the spirit and scope of the invention. Furthermore, various inventions can be made by properly combining plural constituent elements disclosed in the embodiment. For example, some constituent elements of the embodiment may be omitted.

What is claimed is:

1. A voice/music judging apparatus comprising:

a voice/music judgment feature parameter calculating module configured to calculate values of various feature parameters to be used for discriminating between a voice signal and a musical signal from an input audio signal;

a music/background sound judgment feature parameter calculating module configured to similarly calculate values of various feature parameters to be used for discriminating between a musical signal and a background-sound-superimposed voice signal from the input audio signal;

a voice/music characteristic score calculating module configured to calculate a score indicating a likelihood that the input audio signal is a voice signal or a musical signal by multiplying the characteristic parameter values calculated by the voice/music judgment feature parameter calculating module by respective weights that were calculated in advance on the basis of learned parameter values of voice/music reference data and adding up weight-multiplied characteristic parameter values;

a music/background sound characteristic score calculating module configured to calculate a score indicating a likelihood that the input audio signal is a musical signal or a background-sound-superimposed voice signal by multiplying the characteristic parameter values calculated by the music/background sound judgment feature parameter calculating module by respective weights that were calculated in advance on the basis of learned parameter values of music/background sound reference data and adding up weight-multiplied characteristic parameter values; and a voice/music judging module configured to judge whether the input audio signal is a voice signal or a musical signal on the basis of the score calculated by the voice/music signal characteristic score calculating module and, if it is judged a musical signal, to judge whether the input audio signal is a background-sound-superimposed voice signal or not on the basis of the score calculated by the music/background sound characteristic score.

2. The voice/music judging apparatus according to claim 1, wherein the voice/music judgment feature parameter calculating module calculates the feature parameters by dividing the input audio signal into prescribed frames each consisting of plural subframes, calculating pieces of discrimination information to be used for discriminating between a voice signal and a musical signal from the input audio signal on a subframe-by-subframe basis, and calculating a statistical quantity from the pieces of discrimination information for each frame.

3. The voice/music judging apparatus according to claim 1, wherein the voice/music judgment feature parameter calculating module calculates power variations, zero cross frequencies, and power ratios between stereo left and right signals as feature parameters suitable for former-stage judgment processing for judging whether the input audio signal is a voice signal or a musical signal; and the music/background sound judgment feature parameter calculating module calculates degrees of concentration of power components in a particular frequency band corresponding to sound of a musical instrument used for a tune as feature parameters suitable for latter-stage judgment processing for judging whether the input audio signal is a musical signal or a background-sound-superimposed signal.

4. The voice/music judging apparatus according to claim 1, wherein the voice/music judging module judges a signal type by multiple-stage configuration in such a manner as to judge whether the input audio signal is a voice signal or a musical signal on the basis of the score calculated by the voice/music characteristic score calculating module, the input audio signal being judged a voice signal finally if judged so and, if it is judged as a musical signal, judge whether the input audio signal is a musical signal or a background-sound-superimposed voice signal on the basis of the score calculated by the music/background sound characteristic score calculating module for the purpose of preventing the input audio signal from being judged erroneously to be a musical signal being influenced by superimposed background sound though it is actually a voice signal.

5. A voice/music judging method comprising:

calculating various feature parameters to be used for discriminating between a voice signal and a musical signal by providing an input audio signal to a voice/music judgment feature parameter calculating module;

calculating various feature parameters to be used for discriminating between a musical signal and a background-sound-superimposed voice signal by proving the input audio signal to a music/background sound judgment feature parameter calculating module;

calculating a score indicating a likelihood that the input audio signal is a voice signal or a musical signal by providing the calculated voice/music judgment characteristic parameters to a voice/music characteristic score calculating module to multiply the calculated voice/music judgment characteristic parameters by weights that were calculated in advance on the basis of learned parameter values of voice/music reference data and to add up weight-multiplied characteristic parameter values;

calculating a score indicating a likelihood that the input audio signal is a musical signal or a background-sound-superimposed voice signal by providing the calculated music/background sound judgment characteristic parameters to a music/background sound characteristic score calculating module to multiply the calculated music/background sound judgment characteristic parameters by weights that were calculated in advance on the basis of learned parameter values of music/background sound reference data and to add up weight-multiplied characteristic parameter values;

judging whether the input audio signal is a voice signal or a musical signal on the basis of the given voice/music signal characteristic score and the given music/background sound signal characteristic score; and if the input audio signal is judged a musical signal, further judging whether the input audio signal is a background-sound-superimposed voice signal or not on the basis of the score.

* * * * *